US006799951B2

(12) United States Patent
Lifson et al.

(10) Patent No.: US 6,799,951 B2
(45) Date of Patent: Oct. 5, 2004

(54) COMPRESSOR DEGRADATION DETECTION SYSTEM

(75) Inventors: Alexander Lifson, Manlius, NY (US); Michael F. Taras, Fayetteville, NY (US); Howard H. Fraser, Jr., New Woodstock, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/207,407

(22) Filed: Jul. 25, 2002

(65) Prior Publication Data

US 2004/0018096 A1 Jan. 29, 2004

(51) Int. Cl.[7] ..... F04B 49/00; F25B 49/00; F25B 13/00; G01M 1/38; G05D 16/00

(52) U.S. Cl. ..... 417/53; 417/63; 62/127; 62/129; 700/275; 700/299; 700/301

(58) Field of Search ..... 417/53, 63; 62/127, 62/129; 700/275, 9, 28, 29, 30, 32, 33, 282, 299, 300, 301

(56) References Cited

U.S. PATENT DOCUMENTS 4,677,830 A * 7/1987 Sumikawa et al. ..... 62/126
5,083,438 A * 1/1992 McMullin ..... 62/129
5,209,076 A * 5/1993 Kauffman et al. ..... 62/126
5,666,815 A * 9/1997 Aloise ..... 62/129
5,713,007 A * 1/1998 Lecomte et al. ..... 701/14
5,899,091 A * 5/1999 Fraser et al. ..... 62/473
5,987,903 A * 11/1999 Bathla ..... 62/129
6,246,950 B1 * 6/2001 Bessler et al. ..... 701/99
2001/0003903 A1 * 6/2001 Liu et al. ..... 62/129

* cited by examiner

*Primary Examiner*—Justine R. Yu
*Assistant Examiner*—Timothy P. Solak
(74) *Attorney, Agent, or Firm*—Bachman & LaPointe, P.C.

(57) ABSTRACT

A method for detecting compressor degradation includes the steps of providing a dataset for a compressor relating compressor operating parameters to each other; detecting real time actual values of the compressor operating parameters including an evaluated operating parameter; using at least one of the real time actual values and the dataset to determine a predicted value of the evaluated operating parameter; and comparing the predicted value of the evaluated operating parameter to the real time actual value of the evaluated operating parameter. This advantageously allows a prognosis of compressor performance to determine whether performance degradation is occurring.

16 Claims, 2 Drawing Sheets

COMPRESSOR DEGRADATION DETECTION SYSTEM

BACKGROUND OF THE INVENTION

The invention relates to a system and method for detecting compressor degradation and, more particularly, for detecting such degradation prior to compressor failure whereby such a failure can be prevented.

Compressors are used in a wide range of applications wherein they perform potentially critical functions. Unexpected compressor failure can lead to product spoilage, health hazards, and the like. Further, once a compressor has failed, repair is typically more expensive and more time-consuming than preventive maintenance.

It is clear that the need exists for a suitable system and method for detecting compressor degradation prior to failure so that preventive actions can be taken.

It is therefore the primary object of the present invention to provide such a system and method.

Other objects and advantages will appear hereinbelow.

SUMMARY OF THE INVENTION

In accordance with the present invention, the foregoing object is readily attained.

According to the invention, a method is provided for detecting compressor degradation, which method comprises the steps of providing a dataset for a compressor relating compressor operating parameters to each other; detecting real time actual values of said compressor operating parameters including an evaluated operating parameter; using at least one of said real time actual values and said dataset to determine a predicted value of said evaluated operating parameter; and comparing said predicted value of said evaluated operating parameter to said real time actual value of said evaluated operating parameter. This comparison allows determination as to whether degradation in compressor performance has occurred.

A system for detecting compressor degradation is also provided, which comprises a compressor adapted to function at a plurality of operating parameters including an evaluated operating parameter; a processing and storage member for storing at least one dataset for said compressor relating said compressor operating parameters to each other; said processing and storage member being operatively associated with said compressor so as to detect real time actual values of said compressor operating parameters, and being adapted to use said real time actual values and said dataset to determine a predicted value of said evaluated operating parameter; and compare said predicted value of said evaluated operating parameter to said real time actual value of said evaluated operating parameter.

BRIEF DESCRIPTION OF THE DRAWINGS

A detailed description of preferred embodiments of the present invention follows, with reference to the attached drawings wherein.

DETAILED DESCRIPTION

Figure 1:
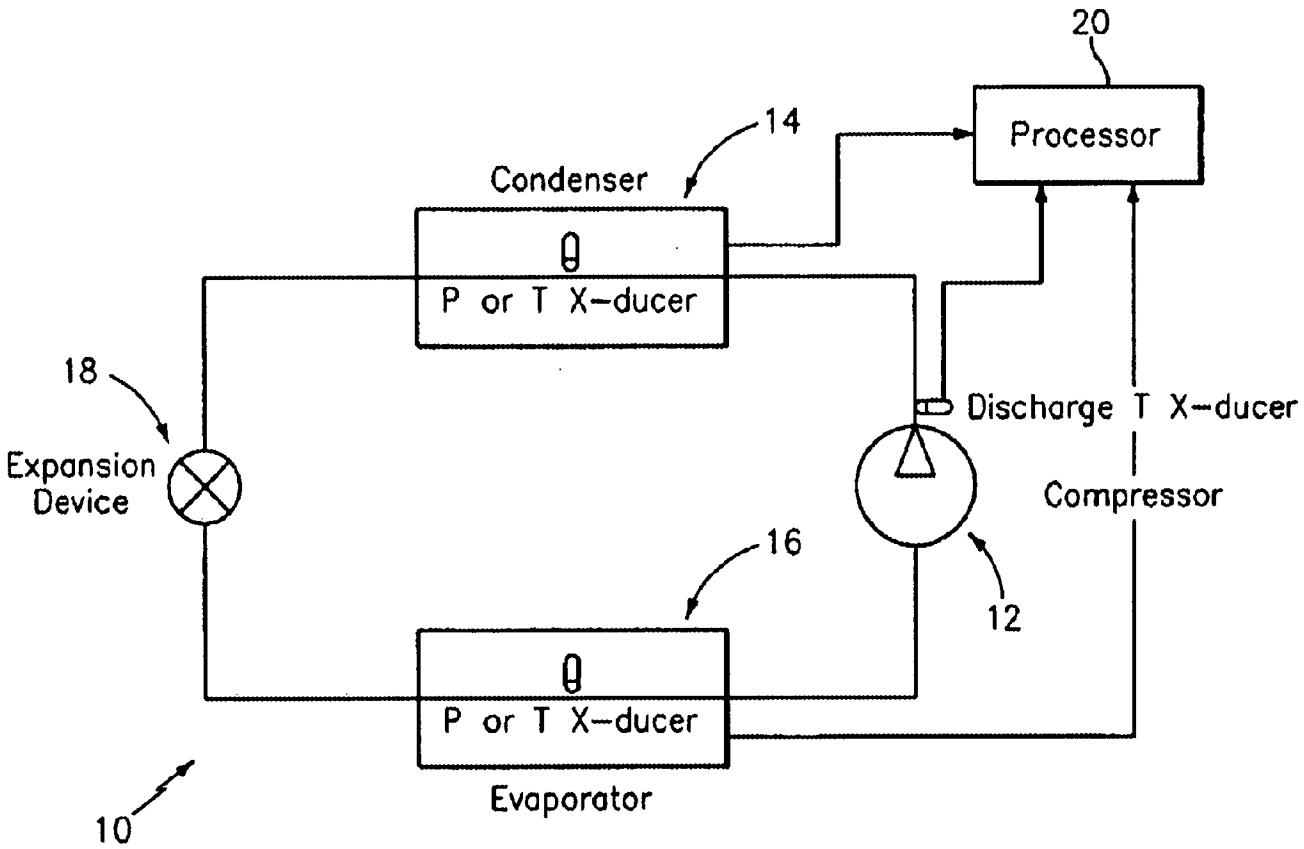
FIG. 1 schematically illustrates a compressor system and method in accordance with the present invention.

The invention relates to a system and method for detecting compressor degradation, and more particularly to a system and method for detecting such degradation by measuring values of certain operating parameters, predicting a value of one operating parameter using the measured values of the other operating parameters, and comparing the predicted value of the parameter to the actual value of the parameter to determine if the compressor is operating as expected.

This advantageously allows for prognosis of potential compressor failure, and allows compressors to be maintained in a preventive manner, thereby avoiding catastrophic failure of the compressor, which can result in more expensive maintenance and repair, extended downtime, spoilage of refrigerated product, and the like.

Referring now to the drawing, a schematic illustration is provided of a refrigerant system 10 including compressor 12, condenser 14, evaporator 16 and expansion device 18. These components are operatively associated with one another, in well known fashion, to perform the desired function. Also as is well known, the compressor operates with various operating parameters, or measurable fluid properties, including compressor suction temperature, compressor suction pressure, compressor discharge pressure and compressor discharge temperature, etc. Other compressor operating parameters include current, voltage, power, superheat (suction and discharge), saturated suction temperature and saturated discharge temperature.

In accordance with a preferred embodiment of the present invention, compressor degradation, prior to failure, is detected based upon measurement of a number of these operating parameters, preferably based upon parameters that are typically independent of each other. Of these measured real time values, a subset is selected, typically three for conventional systems, or four or more for other systems such as economized systems that include a compressor with an intermediate injection port. The subset is utilized with compressor datasets such as rating curves to predict a value of a remaining or evaluated compressor operating parameter, which is also measured. If predicted and measured values deviate significantly from each other this can indicate the need for maintenance.

In connection with the broad scope of the present invention, it should of course be appreciated that real time actual values of compressor operating parameters can be used, in conjunction with a compressor dataset such as a rating curve and the like, in order to determine predicted and actual comparison values which may or may not be actual operating parameters themselves. The thrust of the invention in accordance with the broad scope therein is to determine an expected quantity or value and compare this expected quantity or value to an actually occurring quantity or value to insure that the compressor is operating as expected.

In accordance with the present invention, a processor 20 is advantageously provided, and is preferably operatively associated with measurement devices for obtaining measurements of the desired compressor operating parameters. For example, as shown in the drawing, temperature and pressure readings can readily be obtained with temperature and pressure transducers. Of course, other devices for obtaining such information can be used, as well.

As set forth above, compressors can be provided with datasets such as an associated set or family of compressor rating curves, typically developed from empirical and/or analytical methods, know how and the like, which can be stored in processor 20 for use in accordance with the present invention. Such rating curves would typically be approximated through a system of equations defining or at least closely approximating the relevant functions. This can be done due to the smoothness of such curves. Within the broad scope of this invention, the term datasets could also be provided as test data or analytical data entered in the form of a table or equation, or in any other fashion which relates compressor operating parameters to each other and/or some other comparison value(s).

Processor 20 is preferably advantageously adapted in accordance with the present invention to utilize the diagnostic subset of real time values of compressor operating parameters, in the dataset or rating curves or equations approximating same, so as to predict a value of an evaluated compressor operating parameter, and to compare this predicted value with a real time measured value of the evaluated compressor operating parameter corresponding in time to the values in the diagnostic subset.

Processor 20 is preferably further programmed with a suitable tolerance band within which the evaluated compressor operating parameters can fluctuate without concern. For example, this band can be defined as a plus/minus 5–10%, depending upon the sensitivity of the compressor as to this parameter and the normal fluctuation range of same. Processor 20 is preferably further adapted to signal that attention is needed should the predicted value and actual value of the evaluated compressor operating parameter differ by more than the preset tolerance band. The warning generated by processor 20 can be any type of signal or information indicating that the compressor needs maintenance, or to be replaced, or to be closely monitored for further deterioration in performance, or that any other action known to a person of ordinary skill in the art may need to be taken.

The tolerance band should also take into account the transducer accuracy, equation approximation accuracy, system stability, processor accuracy, etc. A general set of curves can be used if compressors are manufactured within accepted tolerance of plus/minus 5%, which is usually the case.

In connection with a conventional non-economized compressor, three independent compressor operating parameters are typically sufficient for use in predicting other parameter(s) which can be the evaluated parameter. One particular example of parameters that could be suitably used in detecting degradation of such a compressor would be to measure compressor discharge temperature, suction pressure, discharge pressure, and suction temperature. Then, the real time values of suction temperature, suction pressure and discharge pressure as a diagnostic subset of compressor operating parameters can be plugged into datasets such as rating curves for that compressor so as to predict a value for the evaluated discharge temperature. In this example, if the measured discharge temperature value is substantially different, typically higher, than the predicted value from the rating curves, compressor deterioration is indicated. In the case of compressor power as a monitored compressor operating parameter, (instead of discharge temperature), an increase in compressor power above the predicted value would also indicate compressor deterioration.

It is a particular advantage of the present invention that no substantial additional hardware cost is associated with its implementation. The system and method of the present invention can advantageously be adapted utilizing already installed temperature and pressure transducers and processors in existing systems.

The system and method of the present invention are robust, since system-related problems such as a malfunctioning fan, plugged filter, loss of charge, or the like will not interfere with diagnostics of compressor related problems.

Furthermore, the system and method of the present invention can advantageously be utilized in various different stages of a compressor's useful life. First, the system and method of the present invention can advantageously be utilized at the manufacturing facility during run-testing, and can also be used in the field during periodic service intervals, or through permanent monitoring and collection of data, depending upon the needs of the compressor user.

Figure 2:
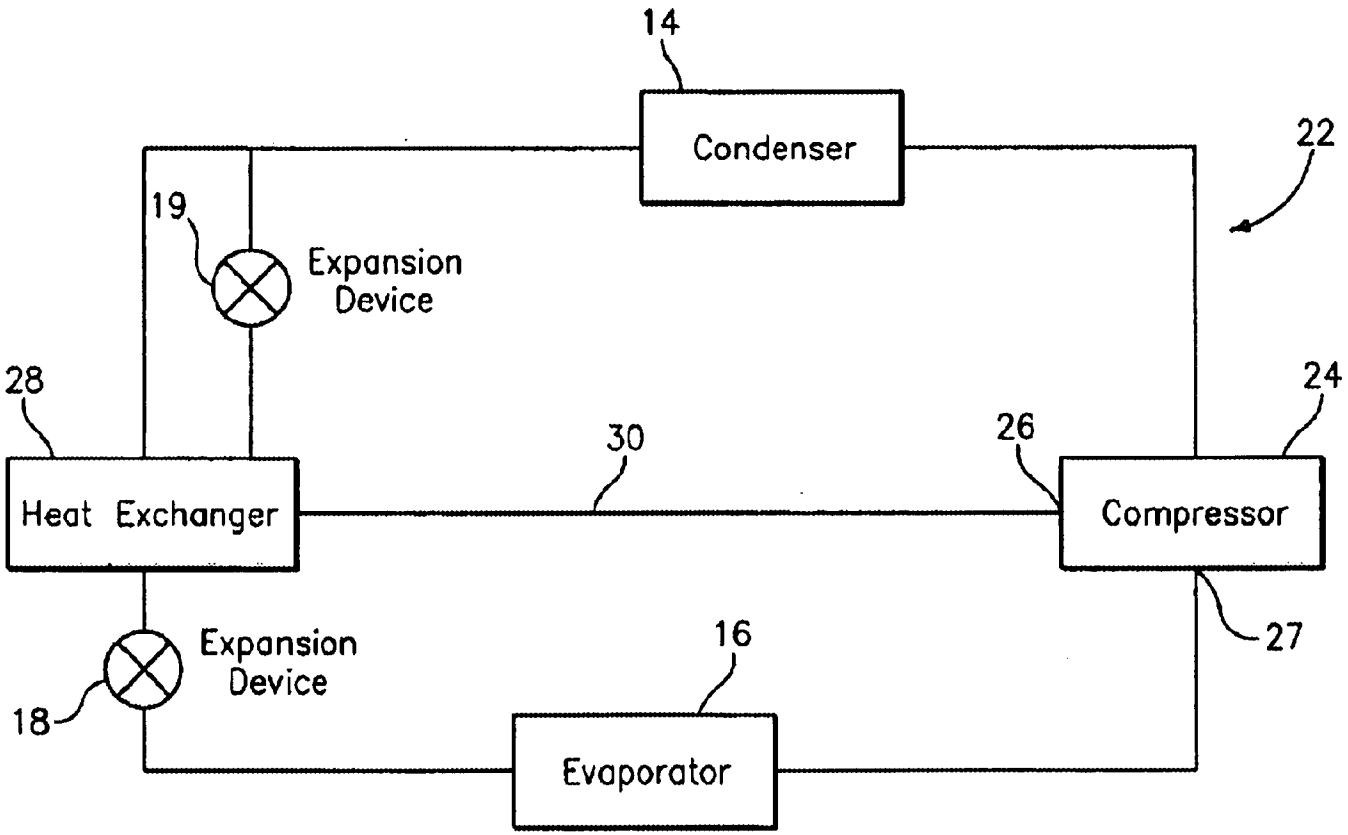
FIG. 2 illustrates a further embodiment of the present invention.

In further accordance with the present invention, some types of compressors may require more than three parameters to be measured or otherwise known. For example should a compressor have an intermediate injection port and operate in an economized mode, five independent parameters will need to be measured. FIG. 2 is a schematic illustration of such a refrigerant compressor system 22 with compressor 24 having an intermediate injection port 26 and a main injection port 27, as well as an additional economizer heat exchanger 28, condenser 14, evaporator 16 and two expansion devices 18, 19. In this embodiment, an additional two parameters which can be evaluated and measured include suction pressure and suction temperature in the economizer line 30 which feeds to intermediate injection port 26, and this allows accurate prediction of a parameter for evaluating in accordance with the invention.

As set forth above, suitable measurement can be obtained and provided to processor 20 utilizing any of numerous well known types of pressure or temperature measuring devices or transducers and the like. In addition, if the compressor is operating at constant suction superheat values, the number of compressor operating parameters can be reduced by one. Further, superheat influence can be predicted with reasonable accuracy, so such values do not need to be stored. Thus, the diagnostic subset according to the invention preferably includes at least two independent parameters, more preferably at least three independent parameters, and in some cases at least four.

Suction and discharge pressures, which are typical parameters to be measured in accordance with the present invention, can be measured directly by pressure transducers or, alternatively, can be deduced from the temperature measurements in the mid portion of evaporator 16 and condenser 14, respectively, which is the configuration illustrated in the drawings. In this embodiment, the measurements define the saturated temperature conditions in the condenser and evaporator and, with some additional calculations based on known refrigerant properties can provide information on suction pressure. Such additional refrigerant property calculations are readily programmed into processor 20 by a person of ordinary skill in the art.

It should readily be appreciated that the datasets or rating curves programmed into processor 20 in accordance with the present invention can be based upon earlier-gathered statistical test data regarding the compressor to be monitored or generated for each particular compressor, if desired. Alternatively, if desired, processor 20 can be adapted to collect this information during an initial run of compressor system 10, until sufficient data is gathered to empirically define the rating curves as desired. In addition, in the case of pre-storage of datasets or rating curves in processor 20, it may be desirable to provide an entire database of rating curves corresponding to any number of known compressors which may be serviced utilizing processor 20. This advantageously allows for a single package to be utilized in installation of a system to perform the method of the present invention on a wide variety of different compressors, wherein processor 20 can readily be adapted to operate with the appropriate type of compressor being monitored, and suitable rating curve applied.

It should readily be appreciated that the system and method of the present invention advantageously provide for detection of compressor degradation, in a robust and reliable manner, which requires little or no investment in additional equipment, and which can be implemented with a wide variety of different compressors. This advantageously allows for avoidance of potentially catastrophic failure of the compressor by early detection of potential problems, which allows for preventive maintenance as desired.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A system for detecting compressor degradation, comprising:

a compressor adapted to function at a plurality of operating parameters including an evaluated operating parameter;

a processing and storage member for storing at least one dataset for said compressor relating said compressor operating parameters to each other;

said processing and storage member being operatively associated with said compressor so as to detect real time actual values of said compressor operating parameters, and being adapted to:

form a diagnostic subset of at least one of said real time actual values, wherein said diagnostic subset does not include said evaluated operating parameter;

use said diagnostic subset and said dataset to determine a predicted value of said evaluated operating parameter; and compare said predicted value of said evaluated operating parameter to said real time actual value of said evaluated operating parameter.

2. A system for detecting compressor degradation, comprising:

a compressor adapted to function at a plurality of operating parameters including an evaluated operating parameter;

a processing and storage member for storing at least one dataset for said compressor relating said compressor operating parameters to each other;

said processing and storage member being operatively associated with said compressor so as to detect real time actual values of said compressor operating parameters, and being adapted to:

use said real time actual values and said dataset to determine a predicted value of said evaluated operating parameter; and compare said predicted value of said evaluated operating parameter to said real time actual value of said evaluated operating parameter, wherein said compressor has a main injection port and in intermediate injection port, and wherein said processing and storage member is operatively associated with said compressor so as to detect real time actual values of said compressor operating parameters related to real time actual values of discharge pressure, main injection port suction pressure, main injection port suction temperature, intermediate injection port suction pressure and intermediate injection port suction temperature.

3. A method for detecting compressor degradation, comprising the steps of:

providing a dataset for a compressor relating compressor operating parameters to predicted comparison values;

detecting real time actual values of said compressor operating parameters;

forming a diagnostic subset of at least one of said real time actual values;

obtaining a real time actual comparison value from said real time actual values;

determining a predicted comparison value from said diagnostic subset and said dataset, wherein said diagnostic subset does not include said real time actual comparison value; and comparing said predicted comparison value to said real time actual comparison value.

4. The method of claim 3, wherein said predicted comparison values and said real time actual comparison value are compressor operating parameters.

5. A method for detecting compressor degradation, comprising the steps of:

providing a dataset for a compressor relating compressor operating parameters to each other;

detecting real time actual values of said compressor operating parameters including an evaluated operating parameter;

forming a diagnostic subset of at least one of said real time actual values, wherein said diagnostic subset does not include said evaluated operating parameter;

using said diagnostic subset and said dataset to determine a predicted value of said evaluated operating parameter; and comparing said predicted value of said evaluated operating parameter to said real time actual value of said evaluated operating parameter.

6. The method of claim 5, wherein said real time actual values comprise real time values of at least two independent compressor operating parameters.

7. The method of claim 5, wherein said real time actual values comprise real time values of at least three independent compressor operating parameters.

8. The method of claim 7, wherein said real time actual values comprise real time actual values of at least four compressor operating parameters.

9. The method of claim 5, wherein said evaluated operating parameter is compressor discharge temperature.

10. The method of claim 5, wherein said evaluated operating parameter is compressor current.

11. The method of claim 5, wherein said evaluated operating parameter is compressor power consumption.

12. The method of claim 5, further comprising the steps of determining a tolerance band of acceptable deviation of said predicted value from said real time actual value, and issuing a notification signal when deviation of said predicted value from said real time actual value exceeds said tolerance band.

13. The method of claim 5, wherein said providing step comprises providing datasets for a plurality of different compressors.

14. The method of claim 5, further comprising the steps of storing said at least one dataset in a memory, and associating said memory with a processor adapted to receive said real time actual values, determine said predicted value and carry out said comparing step.

15. A method for detecting compressor degradation, comprising the steps of:

providing a dataset for a compressor relating compressor operating parameters to each other;

detecting real time actual values of said compressor operating parameters including an evaluated operating parameter;

using at least one of said real time actual values and said dataset to determine a predicted value of said evaluated operating parameter; and comparing said predicted value of said evaluated operating parameter to said real time actual value of said evaluated operating parameter, wherein said evaluated operating parameter is compressor discharge temperature, and wherein said real time actual values comprise real time actual values of suction pressure, discharge pressure and suction temperature.

16. A method for detecting compressor degradation, comprising the steps of:

providing a dataset for a compressor relating compressor operating parameters to each other;

detecting real time actual values of said compressor operating parameters including an evaluated operating parameter;

using at least one of said real time actual values and said dataset to determine a predicted value of said evaluated operating paramater; and comparing said predicted value of said evaluated operating parameter to said real time actual value of said evaluated operating parameter, wherein said compressor has an intermediate injection port and a main injection port, and wherein said real time actual values comprise real time actual values of discharge pressure, main injection port suction pressure, main injection port suction temperature, intermediate injection port suction pressure and intermediate injection port suction temperature.

* * * * *